United States Patent [19]

Fiore

[11] 4,144,895

[45] Mar. 20, 1979

[54] SOLVENT EXTRACTION PROCESS

[75] Inventor: Joseph V. Fiore, Fairfield, Conn.

[73] Assignee: AMF Incorporated, White Plains, N.Y.

[21] Appl. No.: 556,080

[22] Filed: Mar. 6, 1975

[30] Foreign Application Priority Data

Mar. 8, 1974 [GB] United Kingdom ..... 10470/74

[51] Int. Cl.[2] ..... A24B 15/02

[52] U.S. Cl. ..... 131/143

[58] Field of Search ..... 131/142, 143, 2, 17; 260/291; 426/429, 430

[56] References Cited

U.S. PATENT DOCUMENTS

| | | | |
|---|---|---|---|
| 3,390,685 | 7/1968 | Von Bethmann et al. | 131/143 |
| 3,424,171 | 1/1969 | Rooker | 131/143 |

FOREIGN PATENT DOCUMENTS

| | | | |
|---|---|---|---|
| 1109583 | 6/1961 | Fed. Rep. of Germany | 131/143 |

OTHER PUBLICATIONS

*The Chemistry and Technology of Tobacco,* vol. 3, by Shmuk, published by Pishchepromizdat, Moscow, USSR, 1953, p. 120.

*Primary Examiner*—Robert W. Michell
*Assistant Examiner*—Vincent Millin
*Attorney, Agent, or Firm*—George W. Price; Charles J. Worth

[57] ABSTRACT

Processes for the selective removal of lipid constituents from elements of the tobacco plant comprising treating said elements in a solvolysis system consisting essentially of a mixture constituted by a major proportion of a hydrocarbon fat solvent and a minor proportion of a lower alkanol, whereby residual lipid level as determined by Soxhlet extraction is substantially reduced; and smoking compositions incorporating the processed tobacco material.

9 Claims, No Drawings

SOLVENT EXTRACTION PROCESS

Elements of the tobacco plant are known to comprise a proportion of lipids, a component of varying composition, variously defined but most commonly referenced for convenience as included within the hydrocarbon solvent extractables, e.g. from petroleum ether or hexane.

Recently lipids have occasioned interest in the continuing analysis of health related aspects of the use of tobacco. Specifically, it has been suggested that the hydrocarbon solvent solubles contribute to the generation of polynuclear aromatic hydrocarbons during leaf pyrolysis. Experimental results demonstrate that about 70% of the aromatic hydrocarbons, ranging from benzene to benz($\alpha$)pyrene in the pyrolysates are due to leaf components extractable with hexane and acetone, although these extracts amount to less than 25% of dry leaf weight. See "Studies on the Pyrogenesis of Tobacco Smoke Constituents: A Review" Chortyk, O.T. and Schlotzhauer, W.S. Beitrage zur Tabakforschung (Vol. 7, #3, Nov. 1973, pp. 165–177).

There are numbers of lipid fractions characterized by the extraction technique employed. The neutral lipids (commonly defined by high solubility in chloroform) form the major portion of tobacco leaf lipid material, comprising about 60–75% of the total. Accordingly, the most common lipid extraction techniques are based upon chloroform. Other solvent extraction methods are intended principally to remove tobacco solubles and nicotines. In either case, solvent extraction inevitably removes additional chemical substituents, often whose which contribute favorably to taste and aroma. Accordingly, methods are desirably identified for selective treatment of tobacco to minimize the lipid fraction while retaining the physical and chemical integrity of the remaining components.

The neutral lipids which may be observed on tobacco leaf surfaces and are generally associated with the glandular trichomes (hairs) which cover the leaf surface and the cuticle layer just beneath these hairs, may be removed by mechanical techniques, as more fully disclosed in copending and commonly assigned application Ser. No. 556,025 concurrently filed herewith now U.S. Pat. No. 4,018,234.

The internal lipids are generally of somewhat different composition, and may be differentiated into further fractions believed to interrelate with composition.

Some efforts have been made to isolate such fractions in the handling of defatted soybean flakes, and certain solvent treatments are reported to improve color and flavor and to modify the properties of soy proteins, See *AIChE Symposium Series:Food Preservation,* Vol. 69, (1973) No. 132 pp. 5–9, and references cited. However, odor and flavor observations developed by direct application of food compositions to the tongue or palate are not comparable to the smoking experience involving a complex of aesthetic and olfactory responses to the spectrum of individual components developed in mainstream and sidestream in the course of pyrolysis, pyrosynthesis and distillation.

Indeed, the difficulty with selective tobacco extraction may be traceable to the multiplicity of components involved: an extensive composition study on the hexane soluble material of flue-cured leaves (*Chemistry and Industry,* Vol. 14 (1961) pp. 435–6) concluded that the bulk of the constituents could not be fractionated despite intensive effort.

Most importantly, little correlation is available to individually interrelate smokestream components to original tobacco treatment steps, ranging from chloroform or petroleum ether treatments to water washes, bleaches or even the complete extraction reported with a sequence of 95% ethanol, alcohol-benzene, 1% HCl, 5% sulfuric acid and water. Thus, the efficacy of selective treatment sequences remain essentially a matter of considerable experimentation.

It has now been found, however, that the utilization of a particularized solvent extraction technique provides a substantial reduction in tobacco lipids including so-called bound internal lipids with minimized loss of solubles including nicotine and taste and aroma constituents. This result is found to ensue despite the use of a polar solvent component known to be especially effective in the removal of nicotine and tobacco solubles.

Limitations are, however, present in the utilization of this discovery, as it is necessary to observe care in solvent selection and proportion, in order to secure the desired results of this invention, as more fully described hereinafter.

The present invention is concerned with a process for reducing the lipid content of tobacco by contacting the tobacco with a solvent system comprised of a hydrocarbon fat solvent and a lower alkanol. By use of the present invention, the lipid content of the so treated tobacco is reduced substantially in comparison to the results obtained by art-recognized procedures, and organoleptic properties of the resultant smoking compositions may be preferred in comparison to single solvent extraction, such as hexane and petroleum ether extraction. In addition to higher lipid extraction efficiencies realised, there is only slight additional loss of weight of the tobacco, as compared to the substantial weight losses realised by the use of polar solvents on tobacco.

For the purpose of the present process, it is sufficient to merely contact the tobacco with the solvent system to accomplish extraction of the lipid content. For practical reasons, which include the economy of time required, the extractive contact is maintained in the manner dictated by conditions of temperature, physical state of the tobacco, the state of the solvent system (liquid-vapor) and other factors which are familiar to those skilled in the art.

Suitable hydrocarbon fat solvents include liquid saturated hydrocarbons such as liquid alkanes, e.g. pentane, hexane, heptane and mixtures thereof commonly called petroleum ethers; aromatic hydrocarbons such as benzene, xylene and toluene, and cycloaliphatic hydrocarbons such as cyclohexane. Of these, the preferred are the low-boiling alkanes, especially hexane and petroleum ether which are readily volatilized under reduced pressure and/or moderate temperatures, thus permitting facile removal from the tobacco after extraction.

The lower alkanols used in the present solvent system are preferably water-soluble and include methanol, ethanol, propanol, isopropanol and 3°-butanol, all of which are miscible with water in all proportions. Of these, ethanol and isopropanol are preferred for economic reasons coupled with the relative ease of removal at reduced pressure and/or moderate temperatures.

The solvent system is preferably comprised of not more than about 50% alkanol and desirably, should contain from about 15 to about 30% by volume alkanol. When the volume percent of alkanol exceeds 50%, there is a tendency for the solvent system to remove an undesirable proportion of non-lipid constituents of the tobacco which contribute favorably to taste and aroma. Even more significantly, the weight of the tobacco can be noticeably reduced, beyond the expected loss of weight due to lipid removal. This added loss of weight can seriously affect the economics, particularly when the tobacco extracted is in the higher price range. For example, when 100% isopropanol is used, over 18% of the total weight of tobacco is lost, but only 3.7% of the weight loss is lipid, the remaining being alcohol-soluble constituents. On the other hand, when, in accordance with this invention, hexaneisopropanol azeotrope is employed, the total weight loss of the same tobacco is only 6.3% of which 80% is lipid, i.e. 5% of the total tobacco weight. In this same comparison, chloroform-methanol azeotrope caused a 16.8% weight loss whereas the lipid represented only 4.2% of the total tobacco weight i.e. 75% of the total extracted material was non-lipid.

When the solvent system is used in the vapor phase, as in Soxhlet extractions, it is preferred to employ azeotropes of the hydrocarbon-alkanol mixtures. Typical azeotropes are tabulated in the following table:

| Solvent One | Solvent Two | Boiling Point, ° C. | Composition % by Weight One | Two |
|---|---|---|---|---|
| methanol | hexane | 50.9 | 28 | 72 |
| methanol | cyclohexane | 54.2 | 37.2 | 62.8 |
| ethanol | hexane | 58.7 | 21 | 79 |
| ethanol | benzene | 68.2 | 32.4 | 67.6 |
| n-propanol | benzene | 77.1 | 16.9 | 83.1 |
| iso-propanol | hexane | 62.7 | 23 | 77 |
| iso-propanol | benzene | 71.9 | 33.3 | 66.7 |
| n-butanol | heptane | 94.4 | 18 | 82 |

| Solvent One | Solvent Two | Solvent 3 | Boiling Point ° C. | One | Two | Three |
|---|---|---|---|---|---|---|
| ethanol | water | cyclohexane | 62.1 | 17.0 | 7.0 | 76.0 |
| isopropanol | water | cyclohexane | 64.3 | 18.5 | 7.5 | 74.0 |
| ethanol | water | hexane | 68.8 | 12.0 | 3.0 | 85.0 |

The alkanol may contain small amounts of water, at levels up to about 10–12 vol-% of the solvent system. Thus, the alkanol need not be anhydrous to be effective in the solvent system. It is preferred to limit the amounts of water to avoid separation of the solvent system into separate phases.

The extraction process can be effected in any of the art-recognized modes ranging from simple immersion of the tobacco in the solvent to solid-liquid counter-currrent extraction procedures. The extraction can be effected in batch fashion or in a continuous operation, the latter being preferred for commercial operations. Thus, the solvent system, hot or at room temperature can be used, in the liquid phase, or alternatively, in the vapor phase, as in Soxhlet extraction equipment.

The tobacco is preferably in highly comminuted form to reduce the time requirement for extraction. Thus, the tobacco may be comminuted to fine mesh size, e.g. 20 to 100 mesh and even higher, to increase the extraction efficiency. Alternatively, large particle size and even leaf tobacco may be used but the extractive process time requirements are prolonged accordingly. The advantages in higher efficiency in lipid removal and shorter contact periods makes the highly comminuted form preferred, particularly since the comminuted form can be readily cast into tobacco sheet by admixture with suitable adhesives and binding agents by methods well-known in the art of reconstituting tobacco.

In the following examples which further illustrate the invention, there are indicated various lipid determinations, either on unextracted or on extracted tobacco, which determinations are expressed on the basis of the dry weight of the sample prior to residual lipid analysis. Accordingly, no attempt was made to correct the percent lipid values reported for any change in weight that may have occurred, i.e. the change in weight of the extracted tobacco vs. the unextracted tobacco, but rather all % lipids are based on the initial dry weight of the tobacco before lipid analysis. The usual total weight loss of the unextracted tobacco is less than about 10% on extraction with the solvent systems of this invention, of which from about 70 to about 90% is lipid, as determined by solubility in chloroform, a standard art-recognized determination.

EXAMPLE I

12 Gram samples of flue-cured Virginia Bright tobacco (dried at 105° C. for three hours) are extracted with 300 ml. of the designated solvent for 16 hours in Soxhlet extraction equipment. After extraction, the solvent is evaporated and the residue dried for at least two hours at 105° C., then weighed and the percentage extracted from the dried tobacco determined. The lipid character of the residue is determined by dissolving it in chloroform and the percent soluble in chloroform estimated.

| Solvent System | % Extracted | Residue Soluble in $CHCl_3$ |
|---|---|---|
| 1. Hexane | 2.7 | 100% |
| 2. Hexane-ethanol (82:18 v/v) | 3.7 | 90% |
| 3. Hexane-Isopropylalcohol (IPA) (80:20 v/v) | 6.1 | 85% |
| 4. Hexane: IPA: Water (80:15:5 v/v) | 5.7 | 85% |
| 5. Hexane: IPA: Water (80:11:9 v/v) | 7.2 | 80% |

EXAMPLE 2

12 Gram samples of flue-cured Virginia Bright tobacco, one sample dried at 105° C. for three hours, the other samples containing various amounts of water, are Soxhlet extracted with 300 mls of hexane-ethanol (82:18 v/v) for six hours. After extraction the solvent is evaporated and the residue dried for at least two hours at 105° C., then weighed. The percentage extracted from the dried tobacco is determined. The lipid character of the residue is determined by dissolving it in chloroform and the percent soluble in chloroform estimated.

| Sample | % Extracted | Residue Soluble in $CHCl_3$ |
|---|---|---|
| Oven Dried | 5.5 | 90% |

-continued

| Sample | % Extracted | Residue Soluble in $CHCl_3$ |
|---|---|---|
| Room Temp. Equilibrated | 3.9 | 80% |
| Wet with Water | 14.8 | 25% |

EXAMPLE 3

12 Gram samples of air-cured Florida Shade Tobacco (dried at 105° C. for three hours) are Soxhlet extracted with 400 mls of the designated solvent for three hours. After extraction the solvent is evaporated, the residue dried for at least two hours at 105° C., and weighed. The percentage extracted from the dried tobacco is determined. The lipid character of the residue is determined by dissolving it in chloroform and the percent soluble in chloroform estimated.

| Solvent System | % Extracted | Residue Soluble in $CHCl_3$ |
|---|---|---|
| 1.Hexane | 4.2 | 100% |
| 2.Hexane-Methanol (75:25 v/v) | 8.4 | 70% |
| 3.Hexane-Ethanol (82:12 v/v) | 7.2 | 92% |
| 4.Hexane-IPA (80:20 v/v) | 6.3 | 80% |
| 5.Acetone | 5.8 | 80% |

EXAMPLE 4

Chopped flue-cured Virginia Bright tobacco (dried at 105° C. for three hours) is extracted with hexane for five hours and dried. The material is ground and two samples taken: one less than 100 mesh, the other greater than 20 mesh. Twelve gram samples are transferred to Soxhlet extraction equipment and extracted with 300mls of hexane-ethanol (82:18 v/v) for 16 hours. After extraction the solvent is evaporated and the residue dried for at least two hours at 105° C., then weighed. The percentage extracted from the dried tobacco is determined. The lipid character of the residue is determined by dissolving it in chloroform and the percent soluble in chloroform estimated.

| Sample | % Extracted | Residue Soluble in $CHCl_3$ |
|---|---|---|
| Ground (<100) | 4.1 | 90% |
| Unground (>20) | 1.5 | 100% |

EXAMPLE 5

Tobacco samples are counter-current extracted in a commercial unit (feed rate tobacco = 551lbs/hr., solvent, 285 lbs/hr; total residence time of tobacco, 1.8 hrs.) with hexaneisopropyl alcohol (IPA) (82:18) at 125° F. and dried. The reduction of lipid is determined by the difference in lipid content of the tobacco before and after extraction. The lipid content of the tobacco is determined by the 16 hours Soxhlet extraction of tobacco samples before and after the extraction using hexane as the extracting liquid in one case and hexane-ethanol (82:18) azeotrope in the second case with the following results:

| Sample | % lipid (hexane) | % reduced | % lipid (hexane-EtOH) | % reduced |
|---|---|---|---|---|
| Control tobacco | 5.0 | | 6.2 | |

-continued

| Sample | % lipid (hexane) | % reduced | % lipid (hexane-EtOH) | % reduced |
|---|---|---|---|---|
| Extracted tobacco | 0.9 | 81 | 1.1 | 82 |

Nicotine analysis of the tobacco before and after the commercial extraction showed: initial 1.38% per dry gram of tobacco and final 0.55%, or a 60% reduction in nicotine content.

When the time of the commercial extraction is reduced to one hour, the % reduction in lipids is 81% (hexane determination) and 61% (hexane-ethanol determination)

Substitution of methanol, ethanol or n-propanol for IPA in the extracting solvent gives comparable results.

EXAMPLE 6

Samples of tobacco are extracted for 18 hours in a Soxhlet extractor with various solvent systems with the following results:

| Solvent | Nicotine Reduction % (1) | % Extracted (1) | % Soluble in $CHCl_3$ (2) | % lipid in extract (1) |
|---|---|---|---|---|
| Hexane | 33 | 4.1 | 100% | 4.1 |
| IPA | 72 | 18.5 | 20% | 3.7 |
| Hexane-IPA (azeotrope) | 32 | 6.3 | 80% | 5.0 |
| $CHCl_3$ | 34 | 5.8 | 95% | 5.5 |
| $CH_3Cl_3$-Methanol (azeotrope) | 80 | 16.8 | 25% | 4.2 |
| Hexane-Ethanol (azeotrope) | 55 | 6.2 | 80% | 5.0 |

(1)based on dried tobacco weight
(2)based on weight of solubles extracted

The present invention, in utilizing a solvolysis system for elements of the tobacco plant consisting essentially of a mixture constituted by a major proportion of a hydrocarbon fat solvent and a minor proportion of a lower alkanol, permits the reduction of lipids in tobacco with substantial retention of the residual structural integrity of the tobacco elements. The consequence of this phenomenon is that density is reduced, and filling power increased for processed tobacco material used directly in the formulation of smoking compositions, with attendant benefits known to those skilled in the art. Further, and importantly, the selective use of the present treatment medium removes a disproportionately high level of the lipids relative to total weight loss i.e. the ratio of lipid removed to total weight loss in extraction is considerably higher than typical for such operations.

Significance to organoleptic properties of the resultant smoking article is apparent.

What I claim is:

1. A process of treating tobacco to remove lipid therefrom comprising the step of contacting said tobacco with an azeotrope of a hydrocarbon fat solvent and a lower alkanol.

2. A process according to claim 1 wherein said hydrocarbon fat solvent is hexane.

3. A process according to claim 2 wherein said alkanol is isopropanol.

4. A process according to claim 2 wherein said alkanol is ethanol.

5. A process according to claim 2 wherein said system contains up to 50 mol-% alkanol.

6. A process according to claim 5 wherein the ratio of hexane to alkanol is about 80:20.

7. A process according to claim 1 wherein said tobacco is in highly comminuted form.

8. A process for the selective removal of lipid constituents from elements of the tobacco plant comprising treating said elements in a solvent system consisting essentially of an azeotrope mixture constituted by a major proportion of a hydrocarbon fat solvent and a minor proportion of a lower alkanol, whereby residual lipid level as determined by Soxhlet extraction is substantially reduced.

9. A process of treating tobacco to remove lipid therefrom comprising the step of contacting said tobacco with a solvent system comprised of an azeotrope of a hydrocarbon fat solvent and a lower alkanol, said azeotrope being in the vapor phase.

* * * * *